United States Patent [19]

Porter et al.

[11] Patent Number: 4,828,419

[45] Date of Patent: May 9, 1989

[54] CAKE COSMETIC APPLICATOR

[75] Inventors: A. Michael Porter, Franklin, Tenn.; J. R. Spivey; William J. Dee, both of Anaheim, Calif.

[73] Assignees: Cosmolab, Inc., Lewisburg, Tenn.; Spiveco, Inc., Anaheim, Calif.

[21] Appl. No.: 916,340

[22] Filed: Oct. 7, 1986

[51] Int. Cl.[4] ..... A46B 11/00

[52] U.S. Cl. ..... 401/126; 401/123; 132/317

[58] Field of Search ..... 401/202, 243, 247, 118, 401/119, 122–126, 180; 132/88.7, 82 A, 79 A, 79 C

[56] References Cited

U.S. PATENT DOCUMENTS

| | | | |
|---|---|---|---|
| Re. 21,757 | 4/1941 | Deakers et al. | 401/126 |
| 1,362,808 | 12/1920 | McFarland | 401/130 |
| 1,786,418 | 12/1930 | Baquey . | |
| 1,839,548 | 1/1932 | Gimonet | 401/169 |
| 1,909,096 | 5/1933 | Cooney | 401/266 |
| 2,219,000 | 10/1940 | Williams | 132/79 |
| 2,442,503 | 6/1948 | Melnikoff | 132/88.7 |
| 2,570,596 | 10/1951 | Ross | 132/314 |
| 3,084,374 | 4/1963 | Ziegler | 401/122 |
| 3,171,416 | 3/1965 | Pinentel | 132/79 |
| 3,209,730 | 10/1965 | Aston | 401/76 |
| 3,266,079 | 8/1966 | Schwartzman | 401/202 |
| 3,837,749 | 9/1974 | Spatz | 401/130 |
| 3,892,248 | 7/1975 | Kingsford | 132/88.7 |
| 3,951,157 | 4/1976 | Idec | 132/88.7 |
| 4,380,403 | 4/1983 | Endres | 401/247 |

FOREIGN PATENT DOCUMENTS 58-18809 4/1983 Japan .

*Primary Examiner*—Richard J. Apley
*Assistant Examiner*—J. Welsh
*Attorney, Agent, or Firm*—Fitzpatrick, Cella, Harper & Scinto

[57] ABSTRACT

A cosmetic applicator of the type comprising a longitudinally elongated cap that contains a cosmetic cake, a longitudinally elongated barrel holder with a first end supporting a resilient applicator is improved by a longitudinally elongated godet that encloses the cosmetic cake and presents only a substantially transverse exposed surface for contact with said applicator, and an applicator tip that is resilient and expands transversely into a substantial wiping contact with the godet interior wall upon compression against the exposed cake surface. The invention further is characterized by a mounting to rotatably and removably mount the cap upon the barrel at a substantially fixed longitudinal mounting position, and resiliently to maintain a substantially constant pressure during contact between the applicator and the exposed cosmetic surface as the barrel and cap longitudinally are moved into and out of the fixed mounting position.

8 Claims, 1 Drawing Sheet

CAKE COSMETIC APPLICATOR

BACKGROUND OF THE INVENTION

1. Field of the Invention

A pencil-like applicator for containing and applying cosmetics of the cake-type, for improved dispensing of the cosmetic product.

2. Brief Description of the Prior Art

Representative prior art containers and applicators for cosmetics generally are illustrated by the prior U.S. patents, as follows:

McFARLAND U.S. Pat. No. 1,362,808
BAQUEY U.S. Pat. No. 1,786,418
GIMONET U.S. Pat. No. 1,839,548
COONEY U.S. Pat. No. 1,909,096
WILLIAMS U.S. Pat. No. 2,219,000
MELNIKOFF U.S. Pat. No. 2,442,503
ROSS U.S. Pat. No. 2,570,596
ZIEGLOR U.S. Pat. No. 3,084,374
PIMENTEL U.S. Pat. No. 3,171,416
ASTON U.S. Pat. No. 3,209,730
SPATZ U.S. Pat. No. 3,837,749
KINGSFORD U.S. Pat. No. 3,892,248
IDEC U.S. Pat. No. 3,951,157

McFarland illustrates a spring-loaded rouge cake that slides against the cylindrical bore of a holder, and an applicator that engages against a fixed scraper ring mounted above the regressing transverse cake surface, in order to dirty the applicator.

Baquey, at FIG. 2, illustrates a face paint distributor with a movable cap capable of containing a make-up composition against an applicator.

Spatz illustrates a cake cosmetic being held stationery within a cap, and an applicator that is clutched to limit the pressure of the applicator tip against the exposed cosmetic surface; if the applicator previously has been fixed into the cap, and the applicator then moved into contact with the powder.

IDEC illustrates an applicator wherein a stationary, perforated metering tube is used to control dispensing of a surrounding powdered cosmetic.

The other identified references are considered less pertinent to the present invention, and are cited to illustrate various and sundry dispensing devices wherein a cosmetic material is contained within a cap or similar type of holder, and an applicator is allowed to come into contact with the cosmetic through the mechanical act of joining two pieces together.

The present invention is distinguished from the prior art by a cooperation of structure that achieves the several objects of invention listed hereafter.

The present invention categorically applies a cosmetic of the cake variety, and particularly is preferred for cakes with very high pigment loading. A preferred cake for use with this invention has a 70%, by weight, pigment loading, and an average pigment diameter in the range of 30–40 microns. Such a cake best is formed as a slurry and poured into an open cap (known in the art as a godet) and then dried and pressed to define a high-density cake of cosmetic, with essentially no liquid. With such forms of cosmetics, it is critical to ensure that the applicator does not fracture the caked powder, but still dirty itself uniformly during regression of the exposed cosmetic surface inside of the godet. The applicator/exposed surface interface determines the payout of the cosmetic, and must be capable of reproducible results, until all the cake is used up.

Accordingly, it is a first object invention to provide a container and applicator for cake cosmetics of the type having high pigment densities wherein an applicator tip, (preferably of abraded rubber material), is adapted to wipe the interior of the godet and seal the entire exposed cake surface upon contact. The wiping and sealing prevents oxidation of the cake material and removes any resulting hard deposits that tend to adhere to the godet inner wall.

A second object of the present invention is to create an applicator which cannot overstress and crack the cake as a result of either a longitudinal over-insertion, or use of too vigorous insertion pressures. The present invention ensures a uniform pressure at the interface between exposed cosmetic surface and applicator during any point in an insertion motion. Hence, the applicator not only will be uniformly dirty after each insertion, but also the cake cannot be fractured by the applicator.

A third object of the present invention is to define more than one sealing opportunity between the cap assembly and the applicator. For this purpose both the barrel and the cap assembly are elongated and pen-like in nature, and a first seal is defined by the transverse or radial distention of the applicator tip against an exposed substantially transverse cosmetic surface, that typically will have a concave shape from contacts with a cone-like applicator. A second seal is defined between a stop ring for the godet and a narrowed diameter proximate a first end of the applicator barrel. A third seal is defined between a snap ring type of protrusion on the barrel and an annular detent proximate the open end of the cap.

A fourth object of the present invention is to provide an applicator for cake cosmetics which is cylindrical and substantially elongated, and is comprised almost entirely of thin wall aluminum components that are highly finished. Large sliding contact areas also are defined, and are relied upon to define predictable friction rates and also a form of labyrinth seal. The cap assembly substantially is elongated in the longitudinal direction, and surrounds a godet that also substantially is elongated. There is a substantial amount of surface area contact between the outer surface of the godet and the inner surface of the cap. Hence, there may be a type of pneumatic damping of the compression spring rate, as air bleeds into and out of the variable cap volume behind the godet closed end.

A fifth object of the invention is to define a cake cosmetic dispenser with an applicator tip that is porous and able to communicate a liquid within the barrel interior to the applicator surface. For example, a fragrance may be metered out by capillary action (or selective external pressure) towards an applicator tip which is dirtied by contact with an overly dry powder.

The present invention is characterized by novel structure to achieve the above-described objects. The cooperation of structure enables even very high-density cake cosmetics to be dispensed accurately, and not fractured or otherwise damaged by over-insertion pressures. Further advantages, objects and features of the present invention will become more apparent from considering the following summary, and the illustration of a preferred embodiment of the invention.

BRIEF SUMMARY OF THE INVENTION

The present invention comprises an elongated applicator barrel having a first end that supports a resilient applicator tip, together with an longitudinally elongated cap assembly that rotatably and removably can be mounted upon a fixed location of the applicator barrel. The cap assembly further comprises a longitudinally elongated godet which contains a cake cosmetic material and slides in a longitudinal motion between a first position, proximate the open end of the cap, and a second position, proximate the closed end of the cap. The godet normally is urged towards the first position by a resilient member located between the closed end of the godet and the closed end of the surrounding cap.

The applicator barrel preferably is cylindrical and has a reduced diameter at a first end that supports an abraded foam rubber material, such as neoprene or urethane. The applicator tip has a normal contour which preferably is cone-shaped, with a transverse dimension equal to or slightly less than the interior diameter of a cylindrical godet. The applicator tip thereby slides within the godet, and transversely expands upon contact with the exposed cake surface, as it regresses towards the bottom of the godet. Hence, there is a first sealing of the cake cosmetic simultaneously as the applicator tip is being rotated to become dirtied, or is simply stored inside the cap.

The distensible nature of the applicator tip not only seals the entire exposed surface of the cosmetic, but also wipes the interior wall of the godet, just proximate the location to which the cosmetic then has regressed. In this way, hard or oxidized cosmetic particles are not left on the walls and a more uniform payout of material is achieved. Furthermore, there are two (2) additional sealing opportunities between the cap assembly and the applicator barrel. A second seal may be defined between the lock-ring adapted to limit outward motion of the godet from the cap, and a shoulder defined between a narrowed applicator barrel dimension, and the basic applicator barrel diameter. A third sealing may be provided by the snap ring action defined between a raised annulus on the outer surface of the applicator barrel, and an annular detent formed inside the cap near to its open end.

Further advantages and features of the present invention will become more apparent by considering the attached description of a preferred embodiment, wherein reference is made to the accompanying drawings.

DESCRIPTION OF THE PREFERRED EMBODIMENT

Figure 1:
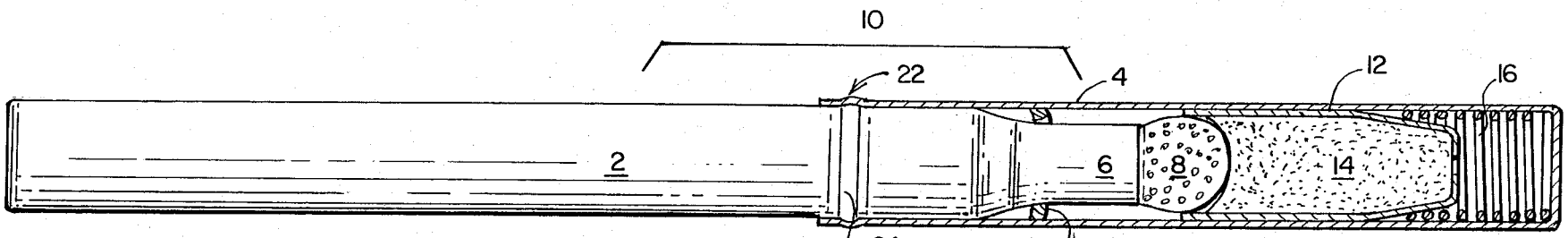
FIG. 1 is a plan view, partially in section, showing an applicator barrel mounted within a cap assembly according to the present invention.

FIG. 1 illustrates an improved cake cosmetic applicator assembly, 10, that basically comprises an elongated cylinder applicator barrel, 2, and a cap assembly, 4. The applicator has a narrowed first end, 6, that supports a porous rubber applicator tip, 8. In FIG. 1, the applicator tip is shown transversely distended from contact against an exposed surface of a cake cosmetic material, 14, that is otherwise sealed within an elongated cup or godet, 12. The godet, 12, is a thin wall aluminum stamping and is adapted to slide between a first position proximate the open end of the cap, as shown at FIG. 3, and a second position proximate the closed end of the cap, as shown in FIG. 1. The applicator tip has been abraded to define a cone-like normal contour, 18, as shown in FIG. 2, with a maximum radial dimension substantially similar to that of the godet interior wall diameter, and slightly greater than the diameter of the narrowed first end, 6.

At FIG. 1, the applicator is in external plan view, and the cap assembly is in section. The cap assembly preferably comprises an elongated thin-wall stamping with an interior dimension that allows for a sliding fit against the exterior surface of an elongated godet, 12. Preferably, the cap and godet are of thin wall aluminum, which is dimensionally stable and provides for predictable frictional characteristics without need for lubricant. As shown in FIGS. 1 and 3, there is a substantial surface area sliding contact between the aluminum cap and the aluminum godet, and this provides a form of labyrinth seal 36, that meters air in and out of the variable volume defined behind the godet. Within that volume, a resilient means, such as a compression spring, 16, may be located. Both the godet and the compression spring are sufficiently elongated so that even with a full cosmetic loading, the godet has room for further travel towards the closed end of the cap. Hence, the spring rate will not be overcome by contact between an exposed cosmetic surface and the applicator tip. In FIG. 3 the godet has been urged to a first or outermost position. It should be appreciated that even if virutally all the cake, 14, were depleted, the applicator tip contour, 18, still would contact and wipe the closed end of the godet. This ensures complete payout and use of the cosmetic filled into the godet. The first position for the godet is limited by a stop mechanism, which preferably is a stop ring, 20, that has been press fit against the interior surface of the cap. As shown by FIG. 1, the snap ring, 20, also may be proximate to a taper between the narrowed barrel dimension, 6, and the applicator barrel outer dimension to define a form of second seal against air infiltration into the cap during storage periods.

Figure 2:
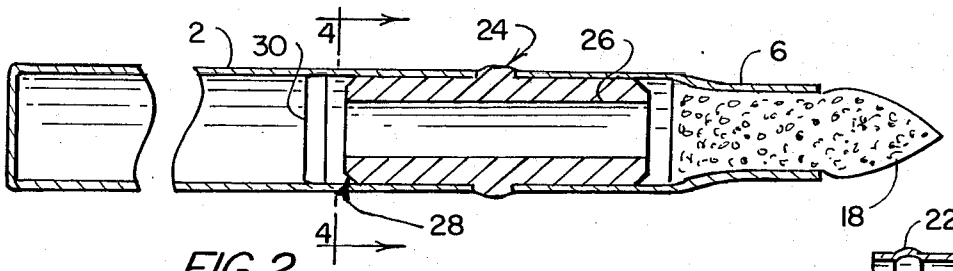
FIG. 2 is a partial section view of the applicator barrel of FIG. 1.
Figure 3:
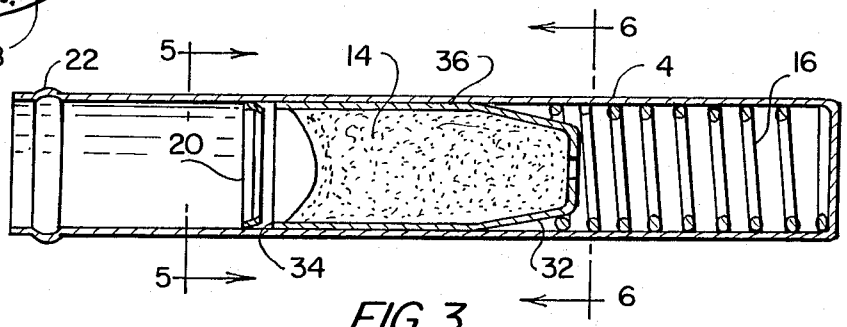
FIG. 3 is a partial section view of the cap assembly of FIG. 1, showing the godet in its outwardmost position.
Figure 4:
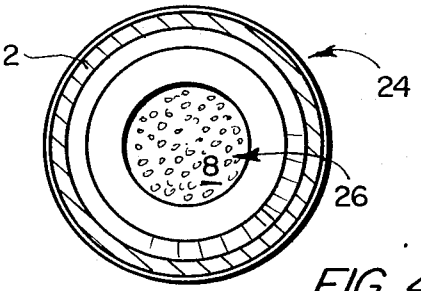
FIG. 4 is a section view of the applicator barrel taken along line 4—4 of FIG. 2.

The third seal may be defined by a snap ring assembly which preferably comprises a plastic insert, 24, that is press-fit between two barrel sections and has an outer dimension slightly greater than the outer dimension of the applicator barrel, as shown in FIGS. 2 and 4. An annular detent, 22, preferably is formed proximate the open end of the cap, to engage with the outer surface of the plastic element, 24. The snap ring insert, 24, also may have a hollow interior bore 26, to enable a large interior volume of the applicator barrel to be communicated with the rear end of the applicator, 8. As shown in FIGS. 2 and 4, the male snap ring element 24, can have beveled edges, 28, to facilitate a press fit against a stop, 30, formed inside a hollow form of applicator barrel, 2. In that way, the rear end of a foam rubber applicator can communicate with a liquid material, (such as a solvent or a perfume) held in the hollow barrel and thereby carry the liquid by capillary action to the outer contour of the applicator tip. As noted hereinbefore, the preferred cosmetic material, 14, has a very high-density of pigment or pearl, such as mica coated with titanium dioxide, and average particle sizes between 30 and 40 microns. Cosmetic materials with such high loadings may not pay out as desired from abrasion by an abraded foam rubber tip, and it is possible to modify payout characteristics by a capillary feeding of a liquid able to create some solvent-like reaction with the cake. Selective feeding of a liquid could also be defined by an external pressure being applied to the barrel's interior volume.

It also should be appreciated that the elongated nature of the cap assembly provides for significant contact areas between the elements, thereby enhancing a sealing of the cosmetic material from outside air. Aluminum-aluminum contacts also are somewhat self-lubricating, and the outer surfaces of a cap and a barrel made of aluminum may be highly finished, as by anodization.

Figure 6:
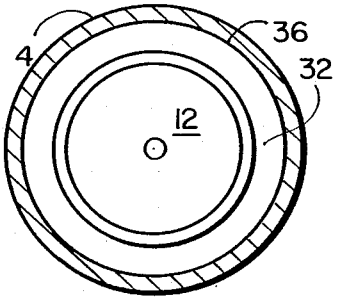
FIG. 6 is a section view through the cap assembly taken along line 6—6 of FIG. 3.
Figure 5:
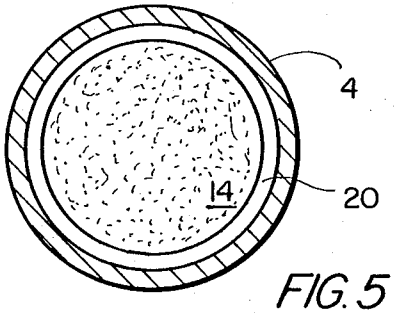
FIG. 5 is a section view of the cap assembly taken along line 5—5 of FIG. 3.

The foregoing structure also allows the cap assembly to be rotated conveniently at a fixed longitudinal relationship with respect to the barrel, due to the interface between the annular detent, 22, and the annular protuberance, 24. The applicator tip also may be stopped from overinsertion by contact of the narrowed applicator portion, 6, with the godet stop ring, 20. Even a fully loaded godet will not bottom out the spring, 16, as shown in FIG. 1. FIGS. 3, 5 and 6 together illustrate that a leading edge, 34, of the godet, 12, abuts an annular projection of stop ring 20, and that the godet may have an angled closed end, 32, to support one end of compression spring, 16. FIGS. 2 and 3 together further illustrate that even if a godet virtually is empty, the applicator tip is dimensioned sufficiently long to wipe against the interior end of the godet upon insertion to the lock position. Hence, the elongated dimensions of the godet and the surrounding cap assembly enable several functional advantages which contribute to an effective protection of fragile cake cosmetic materials.

While a preferred embodiment of the invention has been shown and described, the invention is to be limited solely by the scope of the appended claims.

We claim:

1. An improved cake cosmetic applicator, comprising an elongated applicator barrel with a first end supporting a resilient applicator tip that comprises a curved outer surface and a longitudinally elongated cap assembly that comprises a longitudinally extending godet containing a cake cosmetic material and, means to permit both a rotation and a substantially fixed longitudinal mounting of the cap assembly in surrounding relationship to said applicator barrel first end, wherein the cap assembly further comprises a longitudinally elongated cylinder inner surface, with an open end and a closed end, said cap cylinder inner surface being in sliding engagement around said longitudinally elongated godet that is cylindrical with an open end and is adapted for longitudinal motion between a first position proximate the open end of said cap and a second position proximate the closed end of said cap, wherein the open end of the godet faces the cap open end, and a resilient means between the godet closed end and the cap closed end urges the godet towards said first position, wherein further the applicator tip comprises a resilient material with an outer surface transverse dimension normally less than or substantially equal to a transverse interior dimension of the godet, and adapted to expand transversely upon entering the godet open end and make a longitudinal contact with an exposed transverse surface of the cake cosmetic, thereby substantially sealing the exposed cake surface as the outer surface of the applicator tip urges the godet towards said second position until the means to permit a rotation and substantially fixed longitudinal mounting of the cap assembly is engaged, whereupon a rotation between the cap assembly and the applicator barrel causes the expanded tip outer surface to be dirtied by the cake without permitting excessive longitudinal stresses upon the cake cosmetic, and then permits the applicator tip longitudinally to be withdrawn substantially without contact to the cap cylinder inner suface.

2. The improved applicator of claim 1, wherein said resilient means comprises a compression spring with a first end supported proximate the cap closed end, and a second end that contacts an outer surface proximate the closed end of said godet, and said means to permit both a rotation and a substantially fixed longitudinal mounting of the cap assembly further comprises an annular ring and groove interconnection between a location on an outer surface of the applicator barrel and a location on an inner surface of the cap assembly.

3. The improved applicator of claim 1, wherein the resilient applicator material comprises a porous rubber that extends longitudinally within the applicator barrel first end to communicate with an interior space of the applicator barrel, wherein further said applicator tip is abraded and defines a contour that substantially is cone-shaped.

4. The improved applicator of claim 1, wherein the means to rotatably and removably mount further comprises a first engagement between a distensible portion of the cap and a ring-like transverse extension at a first longitudinal location on a cylindrical applicator barrel outer surface, and a second engagement between a barrel surface portion proximate the barrel first end and a stop ring extending transversely inward at a second location on a cylindrical cap assembly inner surface, the first and second engagements occurring substantially simultaneously at a given degree of insertion between the applicator and the cap.

5. An improved applicator according to claim 4, wherein the ring-like transverse extension comprises a plastic element press-fit between two sections of applicator barrel with a transverse outer dimension slightly greater than the applicator barrel outer dimension wherein the cap distensible portion further comprises an annular indentation on an inner surface of the cylindrical cap that is proximate to the cap open end.

6. The improved applicator of claim 4, wherein the stop ring extends transversely inward to define a circular opening adapted to allow an applicator tip of normal contour to pass therethrough, while defining a wiping contact with an applicator tip that radially has been expanded through contact with an exposed surface of said cake cosmetic.

7. The improved applicator of claim 1, wherein the means to permit both a rotation and a substantially fixed longitudinal mounting of the cap, the resilient means, and the longitudinal length of the barrel between said first and second positions are defined so that the contact forces between the applicator tip and the godet up to and including engagement at the substantially fixed longitudinal mounting of the cap upon the barrel remain substantially constant as cake cosmetic within the godet is depleted, and the exposed cake surface regresses towards the godet closed end.

8. In a cosmetic applicator of the type comprising a longitudinally elongated cap that comprises a cylinder inner surface with an open end and a closed end, said cap cylinder inner surface further being in sliding engagement around a longitudinally extending godet that is cylindrical with an open end and contains a cosmetic cake, wherein further a longitudinally elongated barrel holder with a first end supporting a resilient applicator is adapted to be inserted into the open end of the cap and into the open end of the godet to become dirtied by contact with an exposed surface of the cosmetic cake, the improvement which comprises, in combination, an applicator tip that comprises a curved outer surface with a transverse dimension normally less than or substantially equal to a transverse inner dimension of the longitudinally elongated godet that encloses the cosmetic cake and presents an exposed cake surface for contact with said applicator tip, said applicator tip being resilient and able to expand transversely into a substantial wiping contact with the godet interior wall upon a longitudinal compression against the exposed cake surface, means to permit both a rotation and a substantially fixed longitudinal mounting of the cap upon the barrel at a mounting position so as to dirty a transversely expanded outer surface of the applicator tip against the exposed cake surface by a rotation between the cap and the applicator barrel, while permitting a longitudinal withdrawl of the applicator tip substantially without contacting the cap cylinder inner surface, and means resiliently to maintain a substantially constant pressure during contact between the applicator and the exposed cake surface as the barrel and cap are moved longitudinally into and out of the substantially fixed longitudinal mounting position.

* * * * *